US008555555B2

(12) United States Patent
Cardwell

(10) Patent No.: US 8,555,555 B2
(45) Date of Patent: Oct. 15, 2013

(54) AUTOMATIC RETRACTABLE HATCH GUARD

(76) Inventor: Michael Cardwell, Merrillville, IN (US)

( * ) Notice: Subject to any disclaimer, the term of this patent is extended or adjusted under 35 U.S.C. 154(b) by 0 days.

(21) Appl. No.: 13/074,004

(22) Filed: Mar. 28, 2011

(65) Prior Publication Data

US 2011/0232201 A1 Sep. 29, 2011

Related U.S. Application Data

(60) Provisional application No. 61/318,284, filed on Mar. 27, 2010.

(51) Int. Cl.
*E02D 29/14* (2006.01)

(52) U.S. Cl.
USPC ..... 52/20; 52/72; 52/200; 105/377.06; 105/377.07

(58) Field of Classification Search
USPC ..... 52/19, 72, 200, 20; 105/377.01, 377.03, 105/377.05, 377.06, 377.07
See application file for complete search history.

(56) References Cited

U.S. PATENT DOCUMENTS 3,557,497 A * 1/1971 Schafer et al. ..... 52/1
3,807,528 A * 4/1974 Frank ..... 182/81
4,415,197 A * 11/1983 Meyer ..... 296/216.02
5,282,339 A * 2/1994 Devlin et al. ..... 52/20
6,021,606 A * 2/2000 Kos ..... 49/386
6,422,341 B1 * 7/2002 Engdahl ..... 182/106
6,442,896 B1 * 9/2002 Chapin, III ..... 49/193
6,607,053 B1 * 8/2003 Warren ..... 182/106
7,638,962 B2 * 12/2009 Cardwell ..... 318/484
2005/0006634 A1 * 1/2005 Cuccurullo ..... 256/1
2006/0032706 A1 * 2/2006 Penn ..... 182/103
2007/0095607 A1 * 5/2007 Penn ..... 182/77
2007/0095608 A1 * 5/2007 Taylor ..... 182/78
2007/0234654 A1 * 10/2007 Eriksson et al. ..... 52/184
2007/0241709 A1 * 10/2007 Cardwell ..... 318/484
2010/0031573 A1 * 2/2010 Whiting et al. ..... 49/31
2010/0326769 A1 * 12/2010 Cuccurullo et al. ..... 182/97
2011/0232201 A1 * 9/2011 Cardwell ..... 52/20

FOREIGN PATENT DOCUMENTS

DE 1509491 B * 2/1976
DE 0449091 A1 * 2/1991

* cited by examiner

*Primary Examiner* — William Gilbert
*Assistant Examiner* — James Ference
(74) *Attorney, Agent, or Firm* — David J. Bremer

(57) ABSTRACT

An automatic retractable hatch guard provides enhanced safety and security to hatch openings and comprises retractable assistive handrails and a retractable access step that retracts to fit within a hatch opening and beneath a hatch cover and automatically extends upwards and beyond the hatch opening.

8 Claims, 5 Drawing Sheets

AUTOMATIC RETRACTABLE HATCH GUARD

The automatic retractable hatch guard provides enhanced safety and security to hatch openings in roofs and other walking/working surfaces. The hatch guard can also facilitate hatch conditions that meet or exceed safety standards described by various agencies and industries, for example, safety standards prescribed by the U.S. Occupational Safety and Health Administration (OSHA), standards recommended by the National Roofing Contractors Association (NRCA), and various other interested parties.

Passage through a hatch opening is recognized to be a safety concern. A worker ascending a ladder to a closed hatch can be required to release the ladder with one or both hands in order to unlock and unlatch the hatch cover. It is not uncommon for the worker to have to turn to face away from the ladder to access a hatch cover latch. Furthermore, transitioning from the ladder to a roof surface 63 can require lying over a hatch lip 52 in order to swing the legs and body onto the roof. Similarly, moving through the hatch from the roof to the ladder can require dangling the legs blindly through the hatch opening to reach for the ladder.

The hatch guard can address both the abovementioned situations by providing connecting handrails from the ladder below the hatch to the surface above the hatch. Additionally, the hatch guard can provide a solid, stable, access step above the hatch opening that can enable a worker to turn to face the ladder below as the worker transitions from the surface above to the ladder below.

The hatch guard can be configured with an extended position where the handrails and the access step extend to provide the safety improvements mentioned above, and a retracted position where the hatch guard handrails and step retract to fit within the hatch opening underneath the hatch cover. In the retracted position, the hatch guard can provide the supplementary function of limiting access through the hatch opening, both from the ladder below and from the surface above.

The hatch guard can be configured to move between the extended position and the retracted position in concert with opening and closing a hatch cover. As such, the hatch guard provides improved safety features automatically as needed, and provides improved security features also automatically.

FIGURES

DETAILED DESCRIPTION OF THE INVENTION

The hatch guard can comprise assistive handrails, such as the assistive handrail 11, which extend upwards and outwards from a hatch to provide hand holds for workers as they enter and exit through the hatch.

The handrails 11, when extended, can be positioned oppositely across the treads of a ladder 41 below the hatch. The handrails 11 can extend upwards a distance from the hatch opening to enable a worker to pass through the hatch in a substantially vertical stance. The handrails 11 can provide a secure hand hold to facilitate a worker turning to face the ladder 41 when preparing to descend. Similarly, the handrails 11 can provide a secure hand hold to facilitate a worker stepping from the ladder 41 below up to the surface above.

The hatch guard can further comprise an access step 12 that extends up and over a hatch lip 52 to provide a stable transition platform for the worker when moving from the ladder 41 below the hatch to the surface above, and from the surface above to the ladder 41 below. The access step 12, when extended, can be positioned above the hatch lip 52 and can span at least part of the distance between the handrails 11.

The access step 12 can protect the hatch lip 52 from abrasion and other damage resulting from workers stepping onto the lip 52 as they move back and forth between the upper surface and the ladder 41 below. The access step 12 can provide a stable platform at a predictable height with respect to the hatch lip 52 to facilitate the worker turning to descend the ladder 41 as well as emerging to the surface from the ladder 41.

Figure 1:
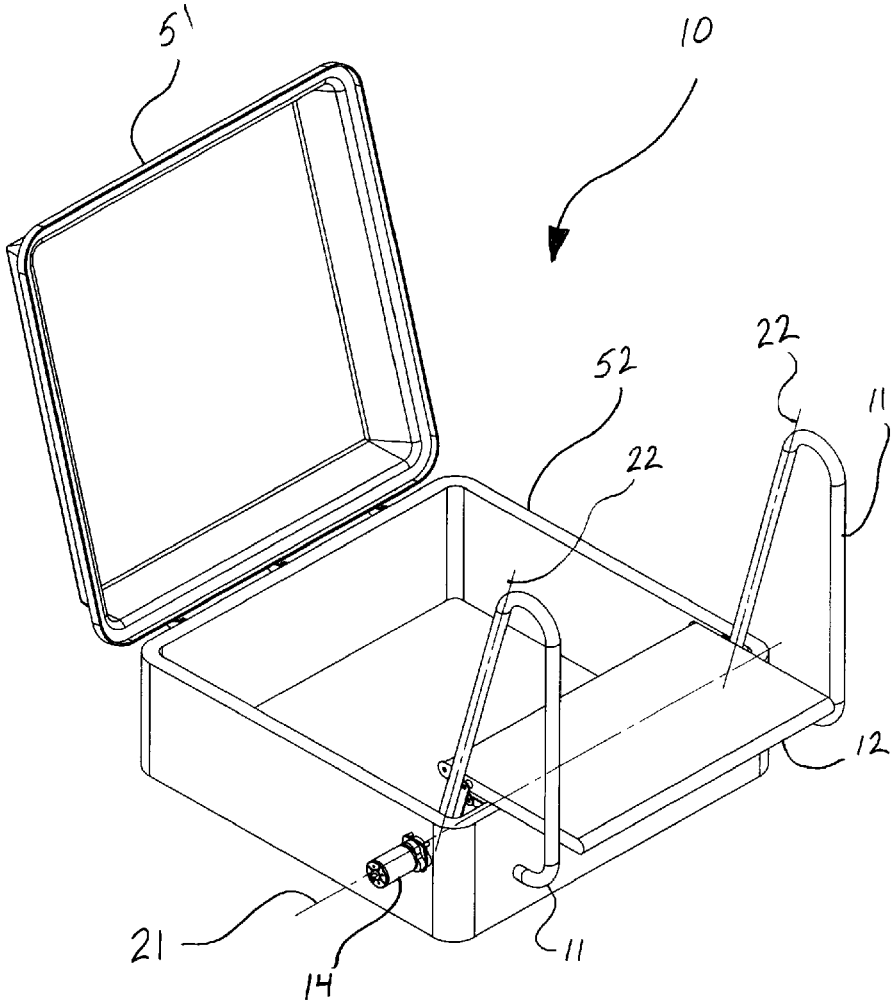
FIG. 1 is an isometric view of an embodiment of the hatch guard with handrails and an access step extended.
Figure 2:
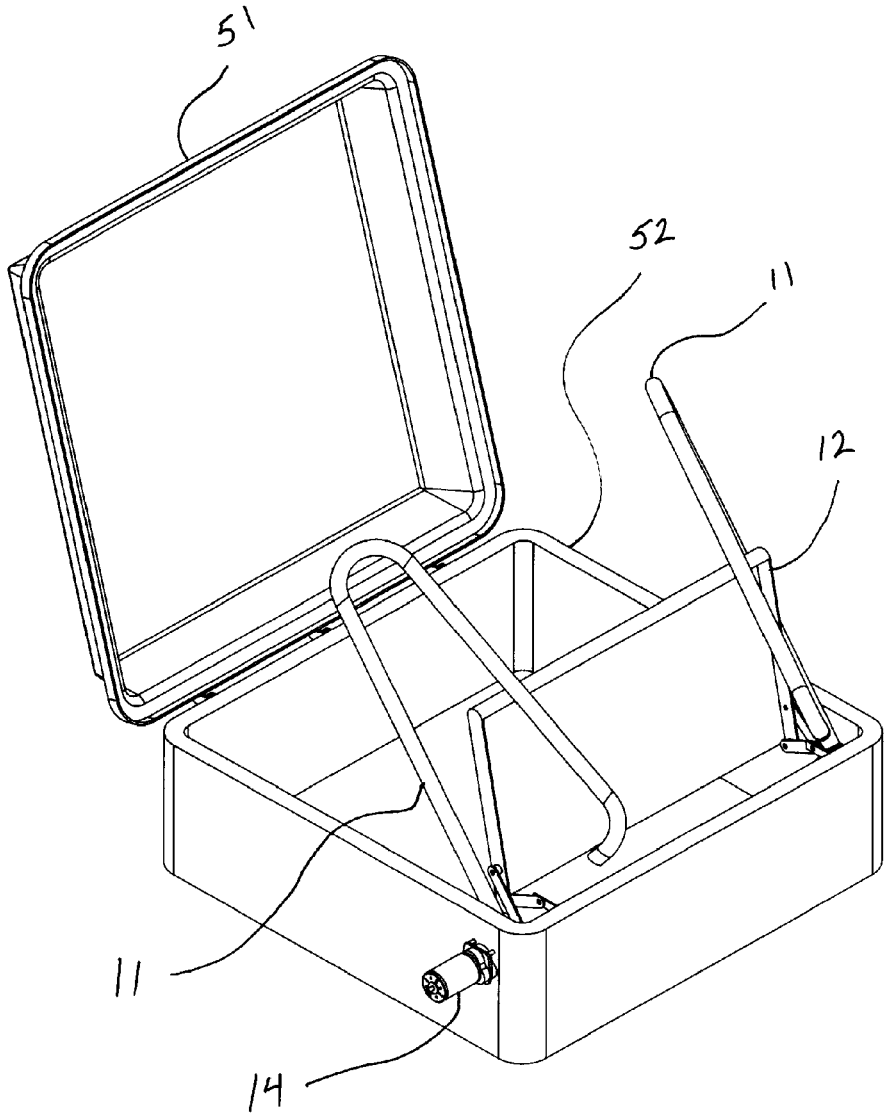
FIG. 2 is an isometric view of the embodiment with the handrails and the access step partially retracted.
Figure 3:
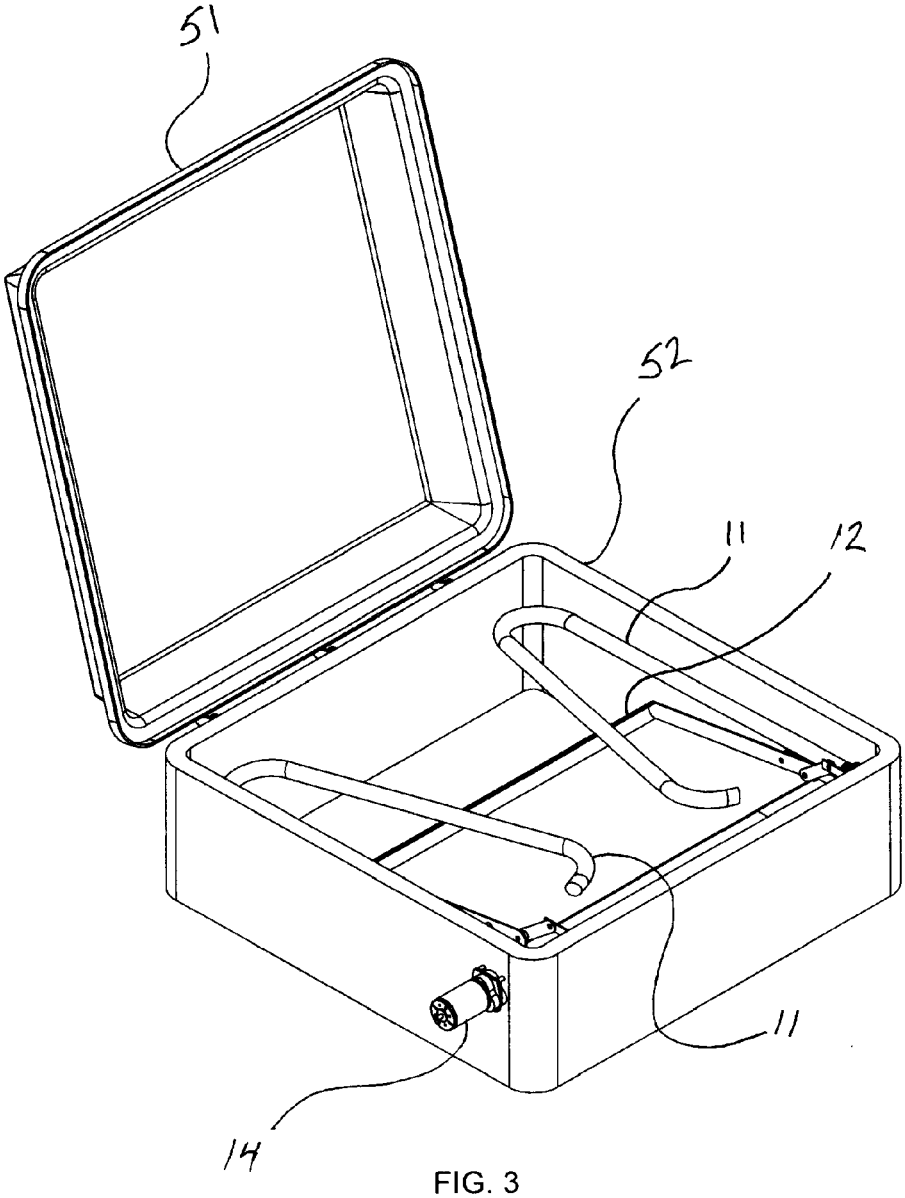
FIG. 3 is an isometric view of the embodiment with the handrails and the access step fully retracted.
Figure 4:
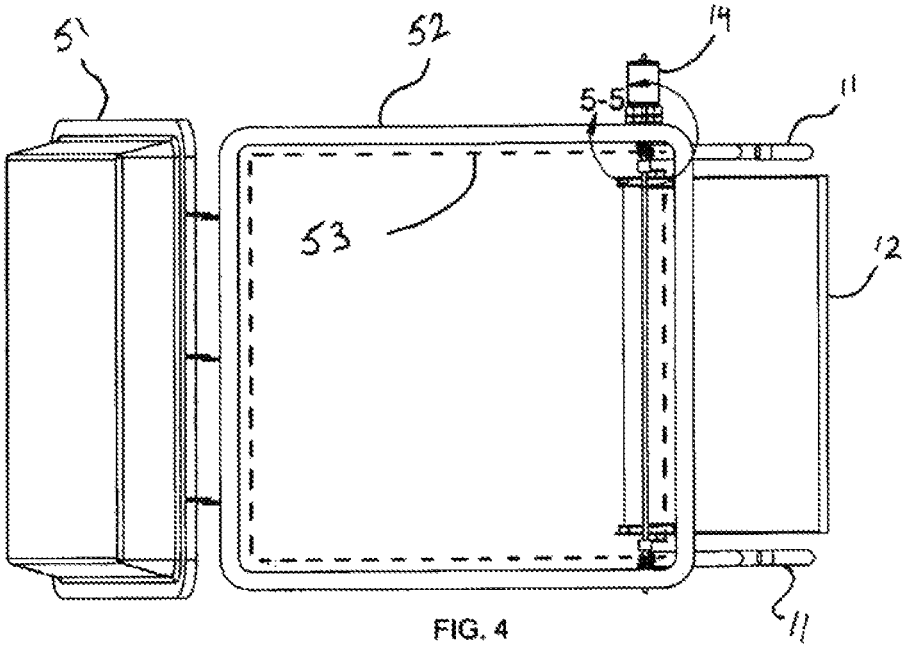
FIG. 4 is a bottom view of the embodiment.
Figure 5:
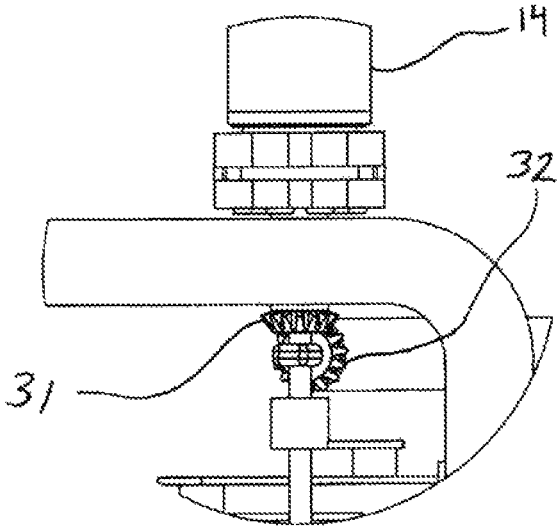
FIG. 5 is a detail view within line 5-5 that shows miter gears for extending and retracting the handrails.
Figure 6:
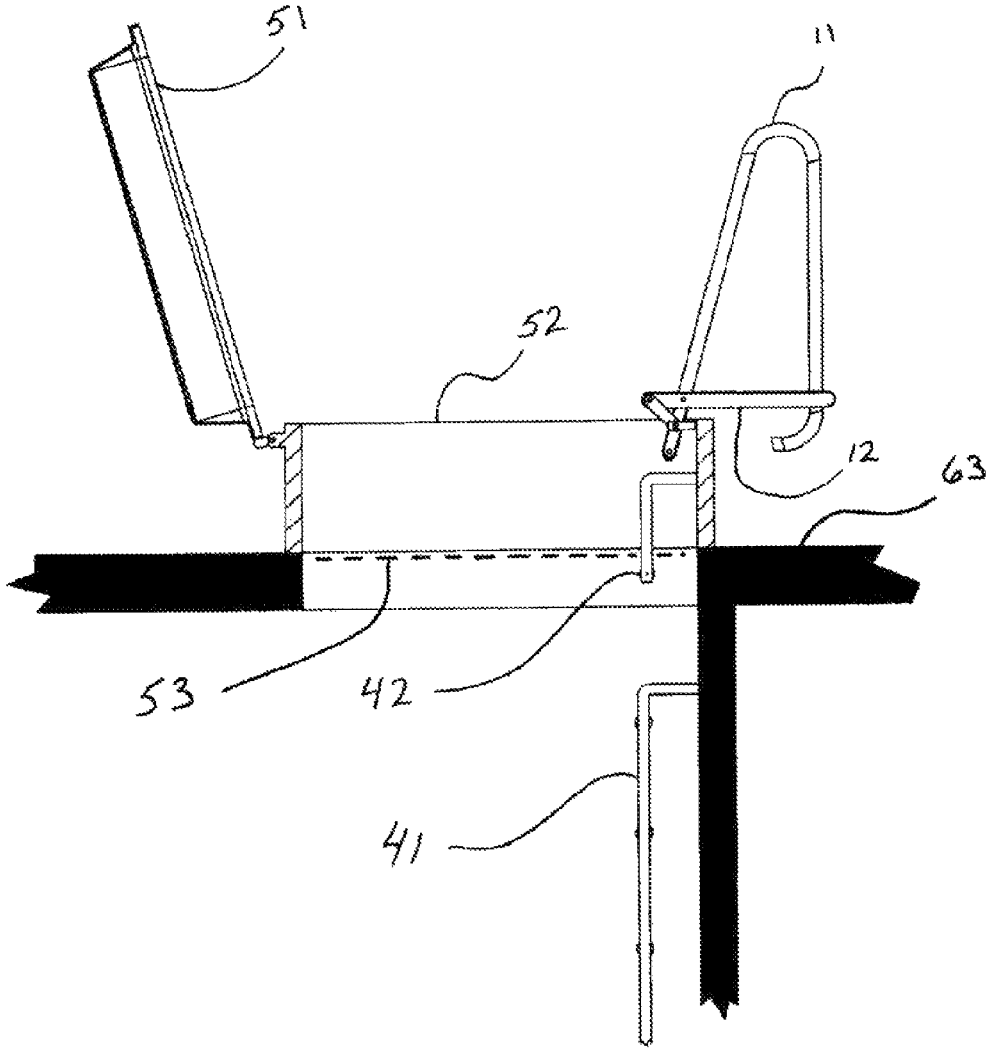
FIG. 6 is a side section view of the embodiment in place on a hatch.

In the embodiment 10, shown in the FIGS. 1-6, the handrails 11 rotate about two axes simultaneously as they extend and retract. The primary axis 21 extends across the hatch opening 53 and the handrails 11 rotate about the primary axis 21 to move in and out of the hatch opening 53.

The secondary axis 22 is perpendicular to the primary axis 21 and rotates about the primary axis 21 along with the handrails 11. The handrails 11 each rotate about respective secondary axes 22 to cover and to expose the hatch opening 53 as the handrails 11 move in and out, respectively, of the hatch opening 53.

The embodiment 10 comprises mechanical means, such as miter gears 31, 32, to move the handrails 11 about the primary and secondary axes, simultaneously. In the embodiment 10, the handrails 11 and the access step 12 can be driven by a single motor 14.

Alternatively, the handrails 11 and the access step 12 can be separately driven by multiple motors, can be moved by linear actuators and by rotary actuators.

The hatch guard can move between the extended position and the retracted position via various mechanisms and modes.

An embodiment of the hatch guard can be configured to be remotely-operated, for example, to extend and retract in response to remote signals. Remote operation provides further safety and security enhancement.

Utilizing the remotely-operated embodiment, a worker can cause the hatch guard to extend and retract the handrails and the access step from a secure position on the walking/working surface, from a position on a lower floor, and from various positions distal to the hatch.

The remote signals can comprise mechanical signals, for example, a cranking signal from an elongated hand crank and a rotating signal from a chain/pulley assembly. The remote signals can comprise various other mechanical signals and combinations of mechanical signals.

The remote signals can comprise transmitted signals from a hatch guard controller. The transmitted signals can be various point-to-point and broadcast transmission forms such as wireless and via wires, cables, and fibers.

The hatch guard can comprise additional safety and security components. For example, the hatch guard can comprise a hatch opening light. The hatch opening light can be activated by the hatch guard extending and retracting. The hatch opening can be activated by a remote signal.

Additionally, the hatch guard can comprise an interior smoke detector and an exterior smoke detector, for sampling the environment inside the hatch and outside the hatch, respectively. Similarly, the hatch guard can comprise an interior dangerous-gas sensor and an exterior dangerous-gas sensor. The smoke detectors and the dangerous-gas sensors can activate audible and visual alarms to alert workers to the presence of the sensed elements.

The hatch guard can comprise a hatch guard controller having a processor, where the controller via the processor causes the hatch guard to extend and retract.

The controller, via the processor, can respond to commands according to programmable instructions. The controller, via the processor, can respond in various ways to commands according to the programmable instructions.

The controller can further comprise a data storage component for storing data, including data in the form of programmable instructions. The controller can be programmable so that executable commands can be input to the controller and so that executable commands can be edited and deleted from the processor. The controller can store data including historical data and the controller can cause the hatch guard to respond according to the historical data. The controller can respond to remote signals to cause the hatch guard to extend and retract. The controller can respond to The hatch guard controller can comprise a hatch cover manager as described in U.S. Pat. No. 7,638,962, issue date Dec. 29, 2009, which is incorporated by reference herein in its entirety.

An embodiment of the hatch guard can comprise a hatch opening mechanism. The hatch opening mechanism can open and close a hatch cover 51 cooperatively with extending and retracting the handrails and access step. The hatch opening mechanism can be separately driven by a motor, can be driven by a motor shared with other hatch guard components, and can be driven by a linear actuator, a rotary actuator, and various mechanical means and combinations thereof. The embodiment so configured can comprise the aforementioned hatch cover manager and can respond to the opening and closing of the hatch cover 51 where the hatch cover 51 is controlled by the hatch cover manager.

The hatch guard can be controlled by the hatch cover manager so that the hatch guard responds to various conditions as described in U.S. Pat. No. 7,638,962.

The hatch guard can comprise a fixed step 42 positioned below the access step 12 when the access step 12 is extended. The fixed step 42 can provide a predetermined step height between the access step 12 and the fixed step 42.

Transitioning from a ladder 41 below, whether the ladder 41 is fixed or temporary, to the surface above can cause uncertainty when the distance from the ladder (and the top step of the ladder) to the surface can vary from hatch to hatch. The fixed step 42 can augment worker safety by minimizing uncertainty regarding the step height between the access step 12 and a first step below the hatch lip. The fixed step can be integral to the hatch guard and can be a separate hatch guard component that is attached to the building structure.

The hatch guard can comprise a standalone unit suitable for retrofit installation on an existing hatch. The hatch guard can comprise a sub-unit of a commercially-available hatch assembly, where some of the hatch guard functions are integrated with the common hatch operations. The hatch guard can comprise a sub-unit of a hatch cover manager as described in U.S. Pat. No. 7,638,962, where hatch guard functions are at least partly integrated with the hatch cover manager functions and where at least some hatch guard functions are controlled the hatch cover manager controller.

The hatch guard can be hardwired to an electric grid to provide power for electric components. Alternatively, the hatch guard can comprise a battery to provide power. Alternatively, the hatch guard can comprise a generator to provide power. Alternatively, the hatch guard can comprise photovoltaic cells to provide power. Alternatively, the hatch guard can comprise various power sources and combinations thereof, including combinations of the aforementioned.

The invention claimed is:

1. A hatch guard configured to facilitate access through a hatch opening in a walking surface, the hatch opening having a hatch lip that is raised above the walking surface, the hatch guard comprising:

at least one handrail having an extended and a retracted position, the at least one handrail in the extended position extending upwards above the hatch lip and crossing the hatch lip to extend outwards across the walking surface from the hatch opening, the at least one handrail in the retracted position being wholly within the hatch opening and wholly below the hatch lip;

an access step having an extended and a retracted position, the access step in the extended position extending horizontally above the hatch lip and crossing the hatch lip to extend outwards across the walking surface from the hatch opening, the access step in the retracted position being wholly within the hatch opening and wholly below the hatch lip; and one or more motion devices, at least one of the one or more motion devices causing the at least one handrail to move from the retracted position of the at least one handrail to the extended position of the at least one handrail and the access step to move from the retracted position of the access step to the extended position of the access step.

2. The hatch guard of claim 1, wherein at least one of the one or more motion devices further causes the at least one handrail to move from the extended position of the at least one handrail to the retracted position of the at least one handrail, and causes the access step to move from the extended position of the access step to the retracted position of the access step.

3. The hatch guard of claim 1, wherein the at least one handrail moves between the extended position of the at least one handrail and the retracted position of the at least one handrail concurrently with the access step moving between the extended position of the access step and the retracted position of the access step.

4. The hatch guard of claim 1, wherein the at least one of the one or more motion devices is a single motor and wherein the single motor causes the at least one handrail to move between the extended position of the at least one handrail and the retracted position of the at least one handrail and also causes the access step to move between the extended position of the access step and the retracted position of the access step.

5. The hatch guard of claim 1, wherein the at least one handrail and the access step each moves, at least in part, between the extended position of the at least one handrail and the retracted position of the at least one handrail and the extended position of the access step and the retracted position of the access step, respectively, by rotating about a common primary axis.

6. The hatch guard of claim 5, wherein the at least one handrail further moves, at least in part, between the extended position of the at least one handrail and the retracted position of the at least one handrail by rotating about a secondary axis that is perpendicular to the primary axis.

7. The hatch guard of claim 6, wherein the secondary axis rotates about the primary axis with the at least one handrail.

8. The hatch guard of claim 1, wherein the at least one handrail comprises two handrails positioned oppositely across the access step.

* * * * *